US009518348B2

(12) United States Patent
Ishikawa

(10) Patent No.: US 9,518,348 B2
(45) Date of Patent: Dec. 13, 2016

(54) SEWING MACHINE HAVING CHANGEABLE PRESSER FOOT

(71) Applicant: Janome Sewing Machine Co., Ltd., Tokyo (JP)

(72) Inventor: Muneyuki Ishikawa, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 14/747,415

(22) Filed: Jun. 23, 2015

(65) Prior Publication Data

US 2016/0215424 A1 Jul. 28, 2016

(30) Foreign Application Priority Data

Jan. 26, 2015 (JP) ..... 2015-012398

(51) Int. Cl.
*D05B 29/08* (2006.01)
*D05B 29/12* (2006.01)

(52) U.S. Cl.
CPC ..... *D05B 29/08* (2013.01); *D05B 29/12* (2013.01)

(58) Field of Classification Search
CPC ..... D05B 29/00; D05B 29/02; D05B 29/04; D05B 29/06; D05B 29/08; D05B 29/10; D05B 29/12
See application file for complete search history.

(56) References Cited

U.S. PATENT DOCUMENTS 4,248,167 A * 2/1981 Reinert ..... D05B 29/00 112/168
4,289,084 A * 9/1981 Takenoya ..... D05B 19/02 112/235
4,389,956 A * 6/1983 Nawa ..... D05B 29/00 112/240
4,416,206 A * 11/1983 Matsumura ..... D05B 3/24 112/277
4,416,208 A 11/1983 Nufer
4,736,697 A 4/1988 Hanyu et al.
5,048,437 A * 9/1991 Jimenez ..... D05B 29/00 112/235

FOREIGN PATENT DOCUMENTS

JP 1981-032669 3/1981
JP 1981-112288 A 9/1981
JP 1990-065892 A 6/1990

* cited by examiner

*Primary Examiner* — Ismael Izaguirre
(74) *Attorney, Agent, or Firm* — Nields, Lemack & Frame, LLC

(57) ABSTRACT

A presser foot has a rod pin and is received by an engagement groove provided with a presser holder. By measuring the resistance value of the rod pin, the rod pin is identified. Terminals are provided with the engagement groove, which contact the rod pin for measuring the resistance. The terminals are connected to a circuit that connects to a circuit of a presser bar. A receiving groove is formed at the presser holder, an inserting part is formed at the lower end of the presser bar, and the presser holder is connected to the presser bar by setting the inserting part in the receiving groove and fixing it. The terminals and the circuit are provided with the inserting part connecting to the electrical resistance measuring apparatus where the resistance of the rod pin is measured, then determination apparatus identifies the rod pin and a display informs the result.

6 Claims, 7 Drawing Sheets

SEWING MACHINE HAVING CHANGEABLE PRESSER FOOT

TECHNICAL FIELD

The present invention relates to a sewing machine having a changeable presser foot.

BACKGROUND ART

A sewing machine has a presser foot for pressing a cloth to be sewed. There are many types of presser foot and popular sewing machines are constructed to be able to change the presser foot for usage.

When changing the presser foot, it is important for a user to recognize the type of the presser foot adapted. When a wrong presser foot for the user's intention is adapted, the stitching with such wrong presser foot cannot be done well and sometimes the presser foot will be damaged.

An idea has been proposed to recognize the type of the presser foot adapted as described in a literature indicated below.

CITATION LIST

Patent Literature

[PTL 1] U.S. Pat. No. 4,416,208

SUMMARY OF THE INVENTION

Technical Problem

The presser foot of the prior art has tappets arranged in a certain code and switches to determine the coding by tappets. Such presser foot is complicated and has a structural limitation in order to recognize many kind of the presser foot.

The present invention is to solve such problems of the prior art.

Solution to Problem

The sewing machine having a changeable presser foot of the present invention comprises, a support member for supporting the presser foot, a plurality of presser foots changeably adapted to said support member, an electrical resistance member provided with said each presser foot having characteristic resistance value, an electrical resistance measuring apparatus for measuring the resistance value of said electrical resistance member, a determination apparatus for identifying the presser foot from the resistance value measured, and a display for informing a result from the determination apparatus.

In the case that said presser foot has a rod pin for being supported by said support member, it is preferable to employ the rod pin as said electrical resistance member. Said support member has preferably a wire circuit for measuring the resistance value of the electrical resistance member. Further said support member may have an engagement groove for receiving said rod pin, a pair of terminals provided in the engagement groove for contacting said rod pin leaving a certain interval, and a wire circuit connected to the terminals for measuring the resistance value.

Said support member preferably has a presser bar and a presser holder adapted to the presser bar.

The preferable embodiment of the present invention comprises a presser holder for supporting a presser foot in attach/detach condition, a presser bar for supporting the presser holder, a plurality of presser foots changeably adapted to the presser holder, a rod pin provide with each presser foot having characteristic electrical resistance value, an engagement groove provided with said presser holder for receiving said rod pin, a pair of terminals provided in the engagement groove for contacting said rod pin keeping a certain distance, a wire circuit for measuring the resistance value provided with said presser holder and presser bar and connected to said terminals, an electrical resistance measuring apparatus for measuring the resistance value of said rod pin, a determination apparatus for identifying the presser foot from the resistance value measured, and a display for informing a result from the determination apparatus.

Advantageous Effects of Invention

According to the sewing machine of the invention, it is easily possible to recognize the presser foot adapted and determine the type, group or the like of the presser foot by measuring the value of electrical resistance. It is also easily possible to increase the types of the identifiable presser foot by only changing the electrical resistance the presser foot.

DESCRIPTION OF EMBODIMENTS

The invention will be described in reference to the embodiment as shown in the attached drawings.

Figure 1:
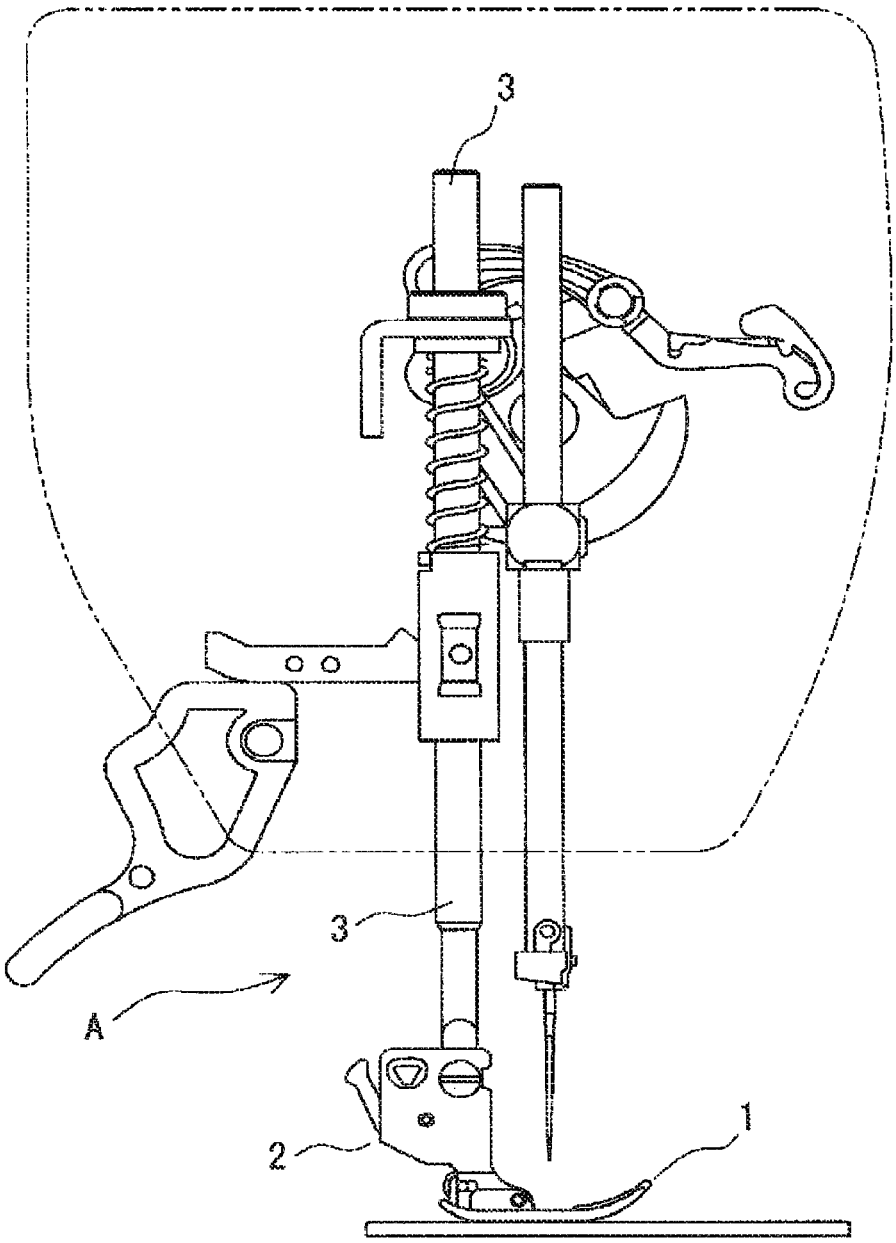
FIG. 1 A side view showing the embodiment of the invention.
Figure 2:
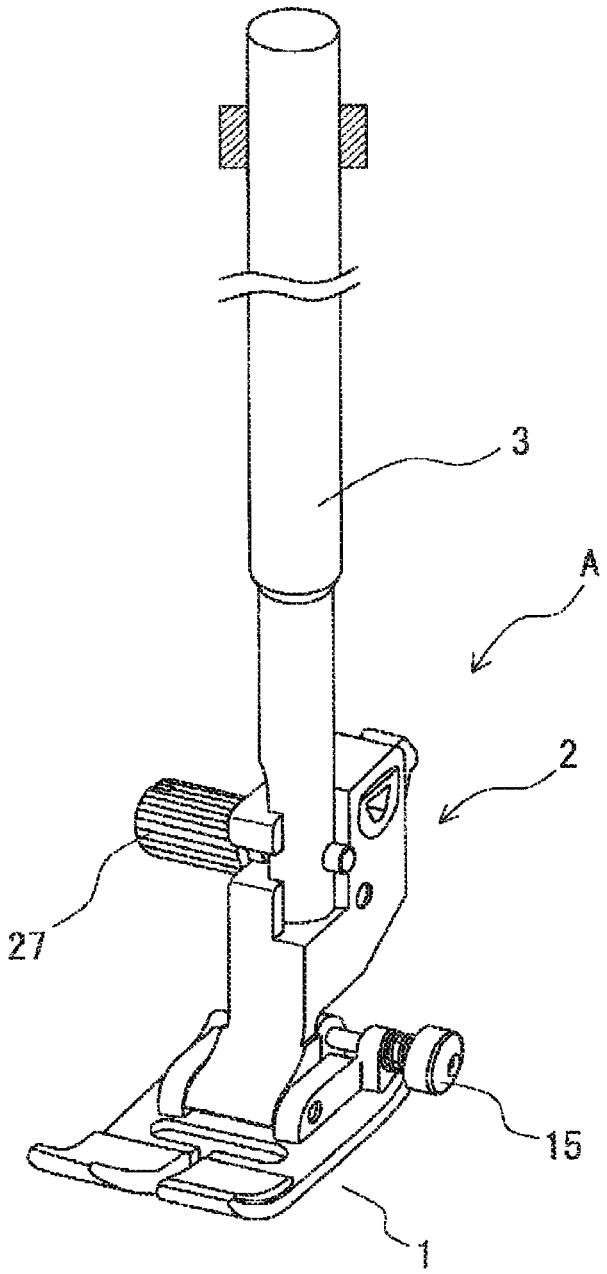
FIG. 2 A perspective view showing a part of the embodiment of the invention.
Figure 3:
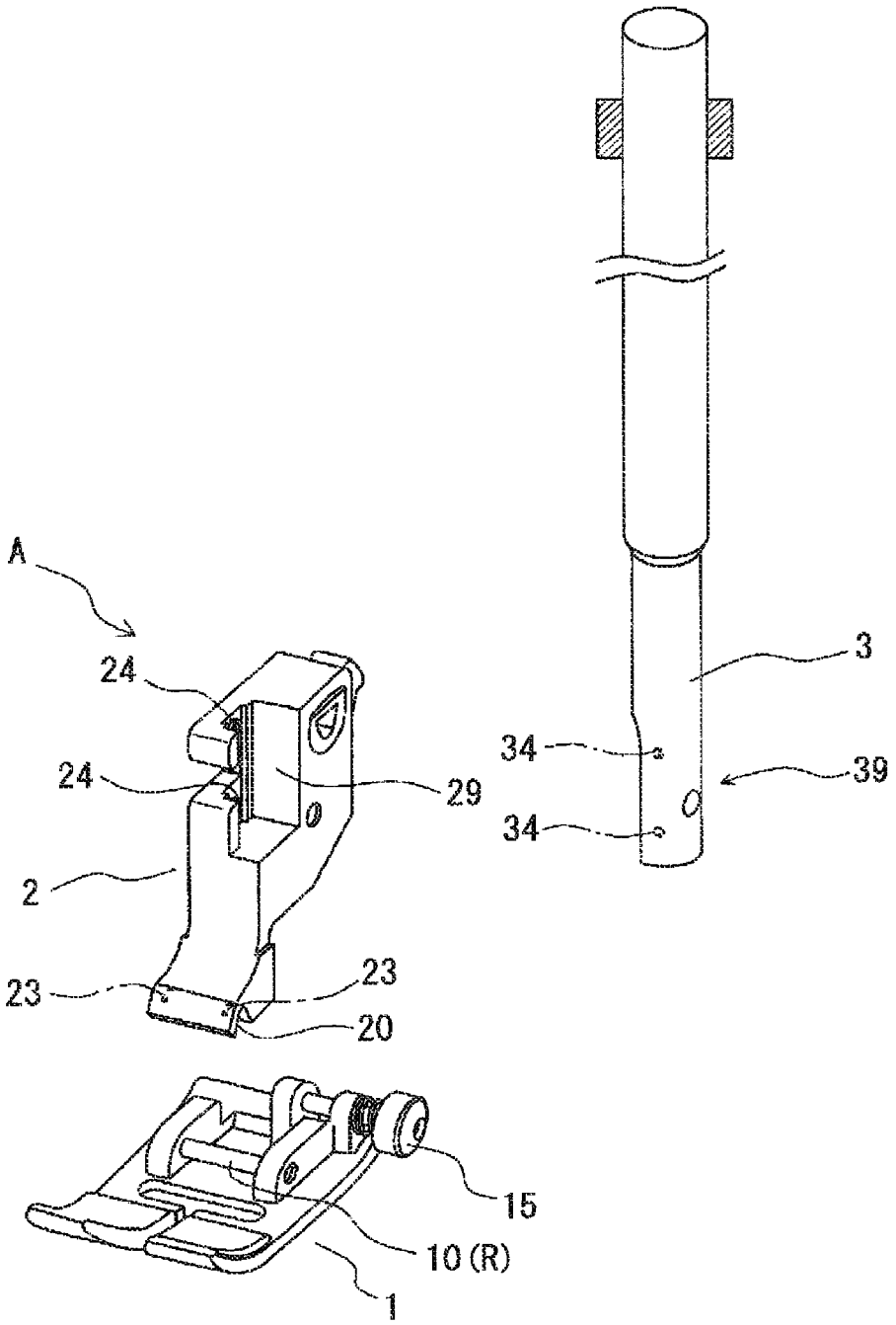
FIG. 3 A perspective exploded view showing the part of the embodiment of the invention.

In FIGS. 1 to 3, a presser foot 1 is supported by a presser holder 2 and a presser bar 3. In the embodiment, the presser holder 2 and the presser bar 3 configure a support member A.

The presser foot 1 has a register member R as shown in FIG. 3 and in the embodiment a rod pin 10 provided with the presser foot 1 is the electrical resistance member R. An engagement groove 20 as a counter part to the rod pin 10 is provided with the presser holder 2. The rod pin 10 is adapted to the engagement groove 20 and fixed by a fix pin 15. The rod pin 10 is rotatable in the engagement groove 20 and the presser foot 1 is rotatably supported in order to follow thickness of a cloth to be sewed.

The rod pin 10 is made of metal electrically conductive and has a characteristic resistance value. By measuring the resistance value, the rod pin 10 adapted can be recognized. The resistance value of the rod pin 10 varies, for example it can be characteristic for each one or it may be the same in the same type of the rod pin 10 or in any characteristic group for usage.

Figure 4:
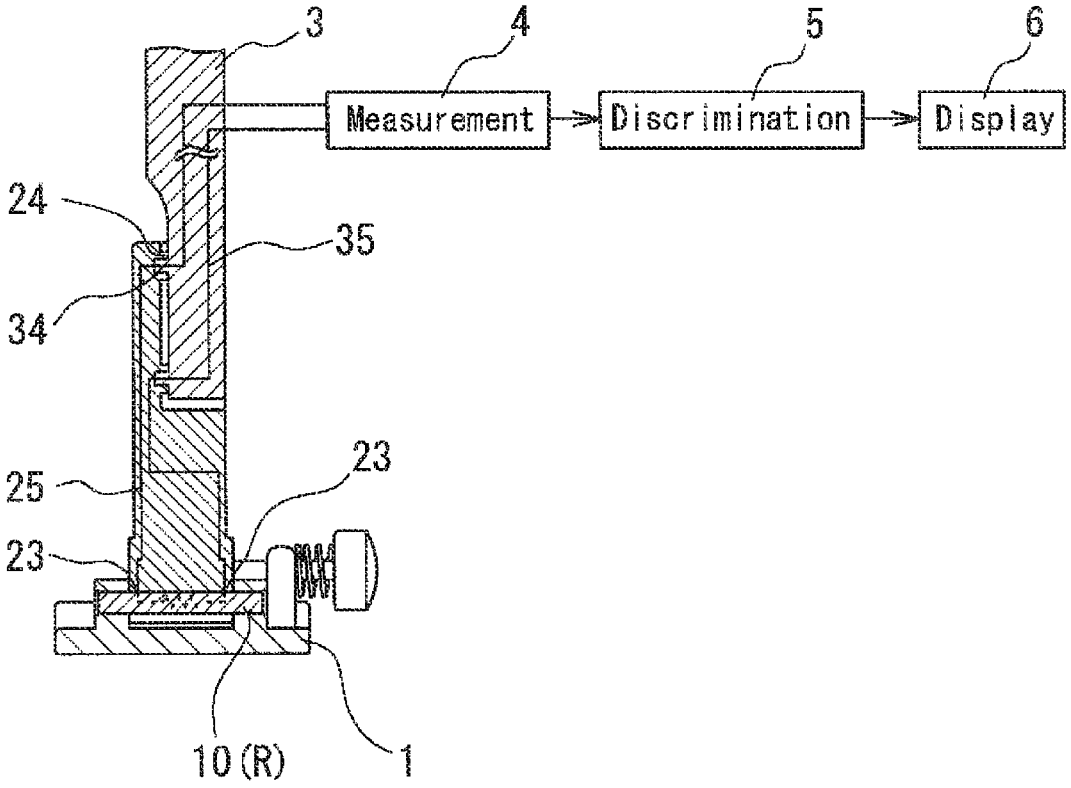
FIG. 4 A block diagram showing the embodiment of the invention.
Figure 5:
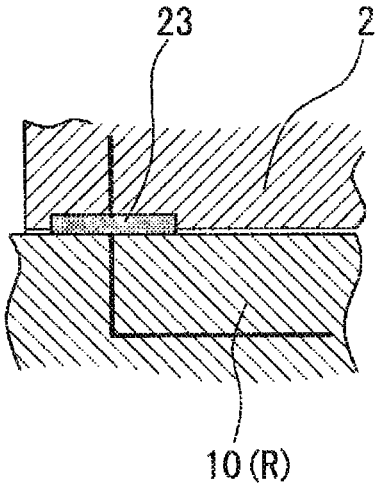
FIG. 5 An explanatory view of the part of the embodiment of the invention.

In the engagement groove 20 of the presser holder 2, terminals 23, 23 are provided as shown in FIGS. 3 to 5. The terminals 23 contact the rod pin 10 for measuring the resistance of the rod pin 10. The terminals 23, 23 are so arranged having some gap as to respectively contact the ends of the rod pin 10.

A circuit 25 is connected to the terminals 23, 23. The circuit 25 is set in a hollow formed in the presser holder 2 and it contacts to a circuit 35 of the presser bar 3 at receiving members 24, 24.

A receiving groove 29 is provided with the presser holder 2 as shown in FIG. 3, and an inserting part 39 is formed with the presser bar 3 at the lower end by cutting the side. The presser holder 2 and the presser bar 3 can be connected by inserting the inserting part 39 into the receiving groove 29 and fixing them by a fixing screw 27.

Said receiving members 24, 24 are provided in the receiving groove 29 and terminals 34, 34 are provided with the inserting part 39 at the counter part of the members 24, 24. The receiving members 24 and the terminals 34 contact each other and make the circuit for measuring the resistance value of the rod pin 10.

Figure 6:
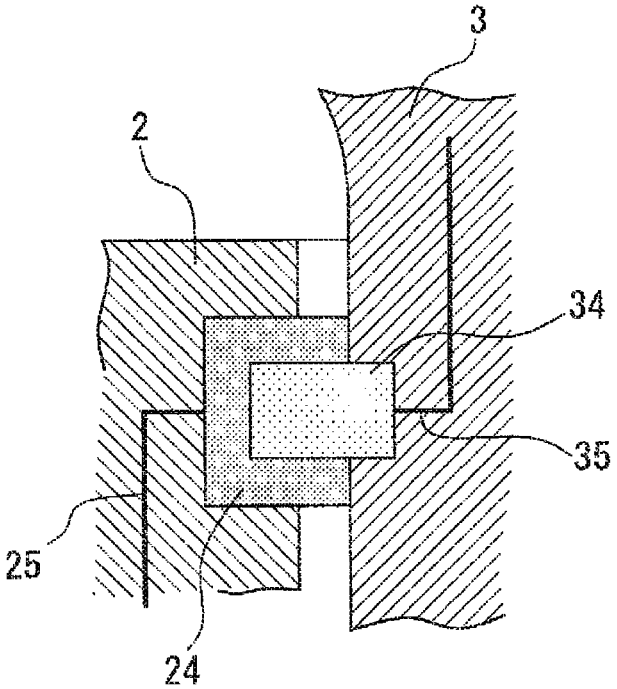
FIG. 6 An explanatory view of the part of the embodiment of the invention.

A hollow part is provided in the presser bar 3 where the circuit 35 is set as shown in FIG. 4. The circuit 35 is connected to the circuit 25 via the terminals 34 as shown in FIG. 6.

As shown in FIG. 4, the circuit 35 is connected to an electrical resistance measuring apparatus 4, which measures the resistance value of the rod pin 10 and a determination apparatus 5 recognizes the rod pin 10 and determines the type, group or the like, then a display 6 informs the type or the like of the rod pin 10 to the user.

Figure 7:
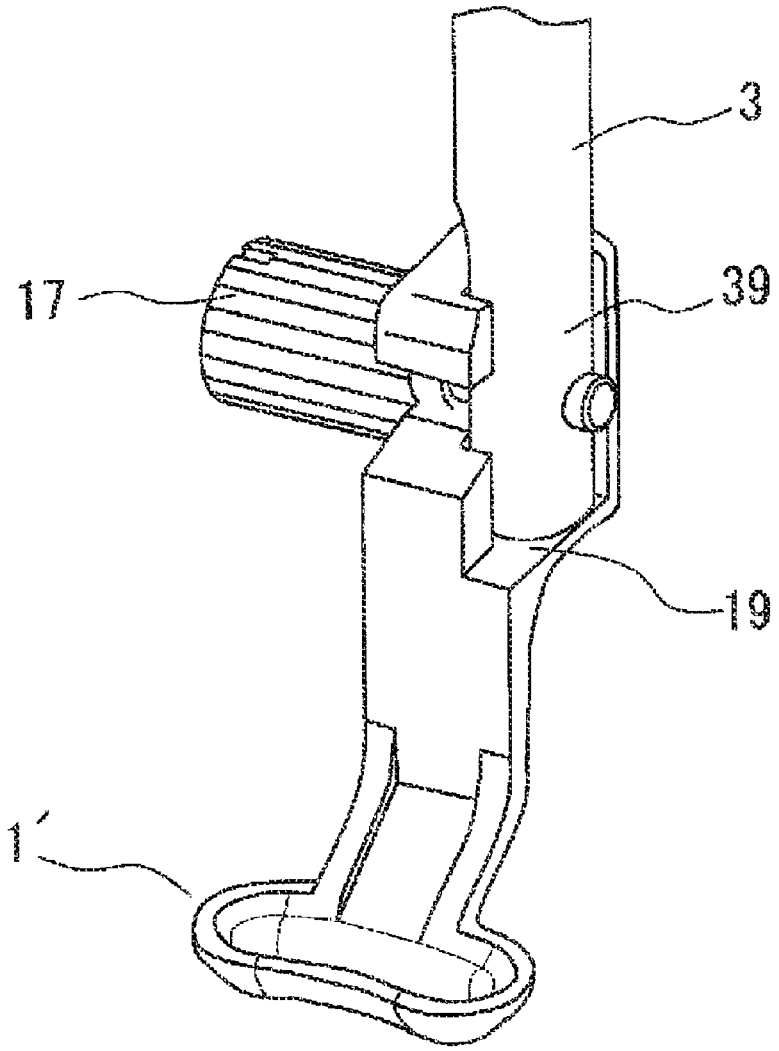
FIG. 7 A perspective view showing a part of another embodiment of the invention.
Figure 8:
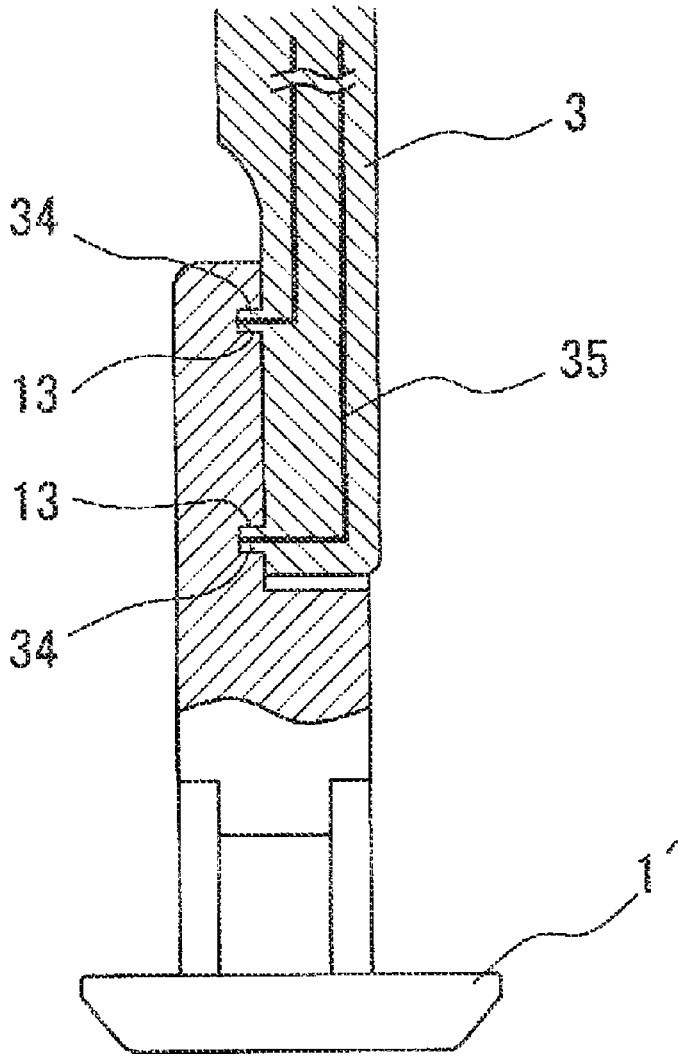
FIG. 8 An explanatory view showing a connection of parts of another embodiment of the invention.

Another embodiment will be described referring to FIGS. 7 and 8. The presser foot 1' is for embroidering and does not have presser holder. The presser foot 1' is directly connected to the presser bar 3. A receiving groove 19 is formed in the presser foot 1' and terminals 13, 13 are provided in the receiving groove 19. The inserting part 39 of the presser bar 3 is set into the receiving groove 19, secured by the fix screw 17 and terminals 34, 34, terminals 13, 13 are connected each other for measuring resistance value of the presser foot 1'. The presser foot 1' may be made of conductive material and the whole of the presser foot 1' can be the resistance member R or only the part between the terminals 13, 13 may be the conductive resistance member R. The resistance value of the member R is set at characteristic value for identifying the presser foot 1' adapted.

The resistance value of the electrical resistance member R may be changed by changing plating of the rod pin 10 or sticking some sheet on the rod pin 10. Other many embodiments can be employed.

According to the embodiments explained, it is easily possible to recognize the presser foot adapted and determine the type, group or the like of the presser foot by measuring the value of electrical resistance member R. It is also easily possible to increase the types of the identifiable presser foot by only changing the electrical resistance member R of the new presser foot. Further the value of the resistance detected at electrical resistance measuring apparatus 4 comes to infinite when no presser foot is adapted and such condition any presser foot is not set can be detected.

REFERENCE SIGNS LIST

1: presser foot, 2: presser holder, 3: presser bar, 4: electrical resistance measuring apparatus, 5: determination apparatus, 6: display, 13: terminal 5: fix pin, 17: fix screw, 19: receiving groove, 20: engagement groove, 23: terminal, 24: receiving member, 25: circuit, 27: fixing screw, 29: receiving groove, 34: terminal, 35: circuit, 39: inserting part.

The invention claimed is:

1. A sewing machine having a changeable presser foot comprising:

A support member for supporting the presser foot,

A plurality of presser foots changeably adapted to attach to said support member, An electrical resistance member provided with said each presser foot, each said electrical resistance member having a characteristic resistance value, An electrical resistance measuring apparatus for measuring the resistance value of said electrical resistance member, A determination apparatus for identifying the presser foot from the resistance value measured, and A display for informing a result from the determination apparatus.

2. The sewing machine according to claim 1, wherein said presser foot has a rod pin for being supported by said support member, and said electrical resistance member is the rod pin.

3. The sewing machine according to claim 1, wherein said support member has a wire circuit for measuring the resistance value of the electrical resistance member.

4. The sewing machine according to claim 2, wherein said support member has an engagement groove for receiving said rod pin, a pair of spaced terminals provided in the engagement groove for contacting said rod pin, and a wire circuit connected to the terminals for measuring the resistance value.

5. The sewing machine according to claim 1, wherein said support member has a presser bar and a presser holder adapted to attach to the presser bar.

6. A sewing machine having a changeable presser foot comprising:

A presser holder for supporting a presser foot in an attach/detach condition,

A presser bar for supporting the presser holder,

A plurality of presser foots changeably adapted to attach to the presser holder, A rod pin provide with each presser foot having a characteristic electrical resistance value, An engagement groove provided with said presser holder for receiving said rod pin, A pair of spaced terminals provided in the engagement groove for contacting said rod pin, A wire circuit for measuring the resistance value provided with said presser holder and presser bar and connected to said terminals, An electrical resistance measuring apparatus for measuring the resistance value of said rod pin, A determination apparatus for identifying the presser foot from the resistance value measured, and A display for informing a result from the determination apparatus.

* * * * *